US006681410B1

(12) United States Patent
Husain

(10) Patent No.: US 6,681,410 B1
(45) Date of Patent: Jan. 27, 2004

(54) TOILET FOOTREST WITH BAR

(76) Inventor: Abbas M. Husain, 8 Bunning Dr., Voorhees, NJ (US) 08043

( * ) Notice: Subject to any disclaimer, the term of this patent is extended or adjusted under 35 U.S.C. 154(b) by 0 days.

(21) Appl. No.: 10/211,921

(22) Filed: Aug. 2, 2002

Related U.S. Application Data

(60) Provisional application No. 60/310,699, filed on Aug. 6, 2001.

(51) Int. Cl.[7] ..... E03D 11/00

(52) U.S. Cl. ..... 4/254; D6/349; 297/423.39; 297/423.44

(58) Field of Search ..... 4/254, 237, 661, 4/905; 297/423.39, 423.4, 423.41, 423.44, 423.45; D6/334, 335, 349

(56) References Cited

U.S. PATENT DOCUMENTS 2,083,605 A 6/1937 Jertberg
4,198,716 A * 4/1980 Hollyday, III ..... 4/254
4,713,846 A 12/1987 Hodroski, Jr.
4,979,240 A 12/1990 Welles
5,282,279 A * 2/1994 Hinton et al. ..... 4/144.1
5,809,583 A 9/1998 Pucciani
6,148,448 A 11/2000 Urso

* cited by examiner

*Primary Examiner*—J. Casimer Jacyna
(74) *Attorney, Agent, or Firm*—Thompson Becker & Bothwell LLC; Robert D. Thompson

(57) ABSTRACT

A toilet footrest to enable a toilet user to raise his or her feet to an elevation above floor level to facilitate defecation. The footrest comprises a vertical member and horizontal members placed at horizontally opposed locations along the vertical member. The toilet footrest with bar may be used with or without a base and may also comprise holes having the same cross-sectional area and shape as the horizontal members and placed at horizontally opposed locations along the length of the vertical member. The base of the toilet footrest with bar may also be "U"-shaped to permit easy storage at the base of the toilet. This embodiment permits the user to vary the location of the horizontal members along the vertical member thereby permitting the user to vary the elevation of his/her feet.

6 Claims, 5 Drawing Sheets

TOILET FOOTREST WITH BAR

This application claims benefit of Provisional application No. 60/310,699 filed Aug. 6, 2001.

CROSS-REFERENCES TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION (1) Field of Invention

This invention pertains to Class 4: Baths, Closets, Sinks and Spittoons; Sub-Class 254: Closet Head, Foot and Body Rests.

(2) Description of the Related Art

This invention discloses a portable foot elevator for easing human defecation. It is a well-known fact that western toilets are not effective in making use of the pelvic muscles in defecation. As designed, modern day toilets do not allow enough flexion of the thigh and pelvic muscles but the strength of these muscles can be enhanced and brought into play with the instant device. The device would be especially useful to debilitated people such as those in nursing homes who are chronically constipated. Such people especially have problems defecating because their muscles are weak. The instant invention provides a simple and inexpensive portable means for the user to elevate his or her feet thereby improving the angle of the legs of the user to enhance the ease of defecation.

The prior art comprises a number of devices for use in elevating the feet of the toiler user. The patent issued to Jertberg, U.S. Pat. No. 2,083,605, discloses a footrest comprised of a box with an adjustable footrest. The device incorporates a complex system for changing the elevation of the footrests as compared to the simplicity of the instant invention where, in one mode, the elevation of the footrest can be changed by merely moving the horizontal members which comprise the footrest to different holes in the vertical member. The patents issued to Hodroski and Welles, U.S. Pat. Nos. 4,713,846 and 4,979,240 respectively, disclose what are essentially footrests which raise the elevation of the feet to a specified level. While the incline of the footrest in Hodroski does provide some variation in the level of elevation of the feet, that variation is limited by the structure itself which is not the case with the instant invention The patents issued to Pucciani and Urso, U.S. Pat. Nos. 5,809,583 and 6,148,448, respectively both disclose complex methods of varying the height of the footrest.

The devices disclosed in the prior art have a number of disadvantages when compared to the instant invention. They are generally large and not easy to move, where they have the capability of adjustable height, the method for adjustment is complex; and they are not easy to set up and use.

BRIEF SUMMARY OF THE INVENTION

The toilet footrest with bar provides a simple and inexpensive means for the toilet user to assume a semi-squat position during elimination. The invention comprises a vertical member with one or more pairs of horizontal members attached to the vertical member at horizontally opposed locations. The device may also comprise a base to maintain the vertical member in a vertical position. The base may be "U"-shaped to allow for storage at the base of the toilet. Another variation of the device discloses holes located along the length of the vertical member, having the same cross-sectional shape and area as the horizontal members, into which the horizontal members may be inserted to provide a multiplicity of foot positions at various locations along the vertical member.

BRIEF DESCRIPTION OF SEVERAL VIEWS OF THE DRAWINGS

The invention will be explained with reference to FIGS. 1 through 5.

DETAILED DESCRIPTION OF THE INVENTION

The detailed description set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
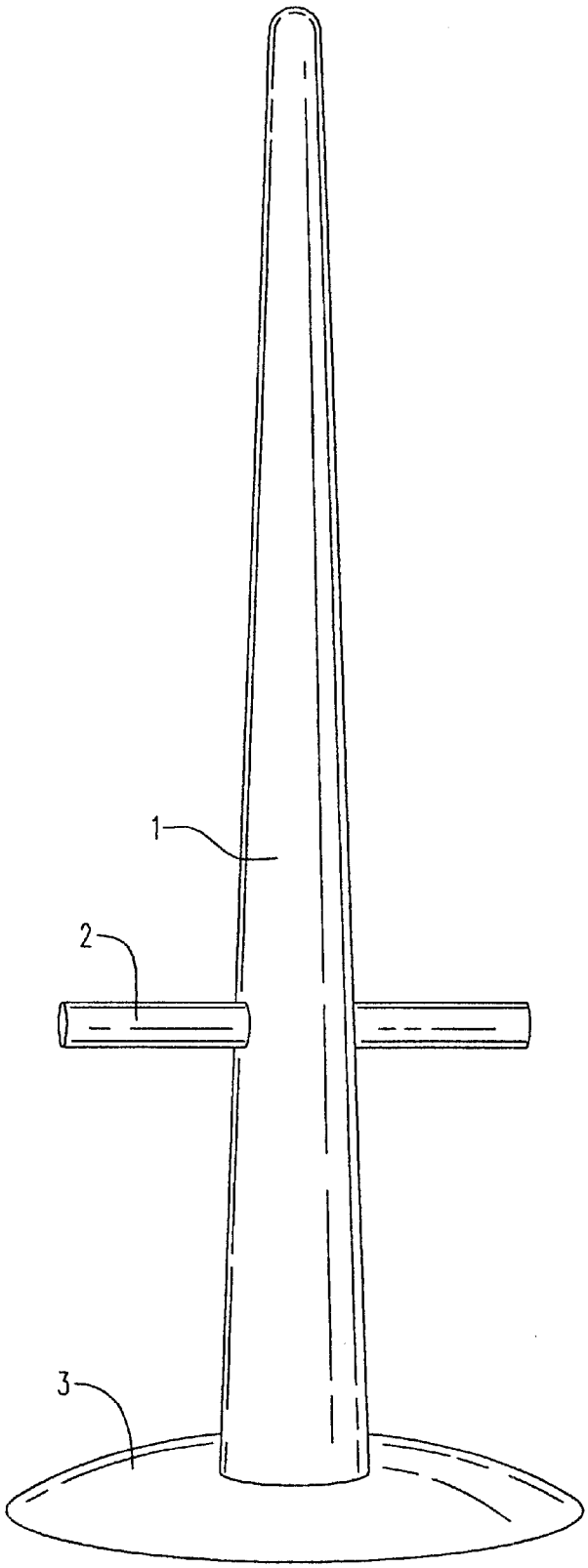
FIG. 1 is a perspective view of the toilet footrest with bar with a set of horizontal members and a base.

The Toilet Assistant For Constipation is illustrated in FIGS. 1, 2, 3, 4 and 5 which depict preferred embodiments of the invention. Referring to FIG. 1, the device and a preferred embodiment are shown. The device comprises a vertical member 1 and two horizontal members 2 attached to the vertical member 1 at horizontally opposed locations. The user of the device places the end of the vertical member 1 on the floor and his or her feet on the horizontal members 2 thereby raising them in relation to the user's abdominal area to facilitate defecation.

Figure 2:
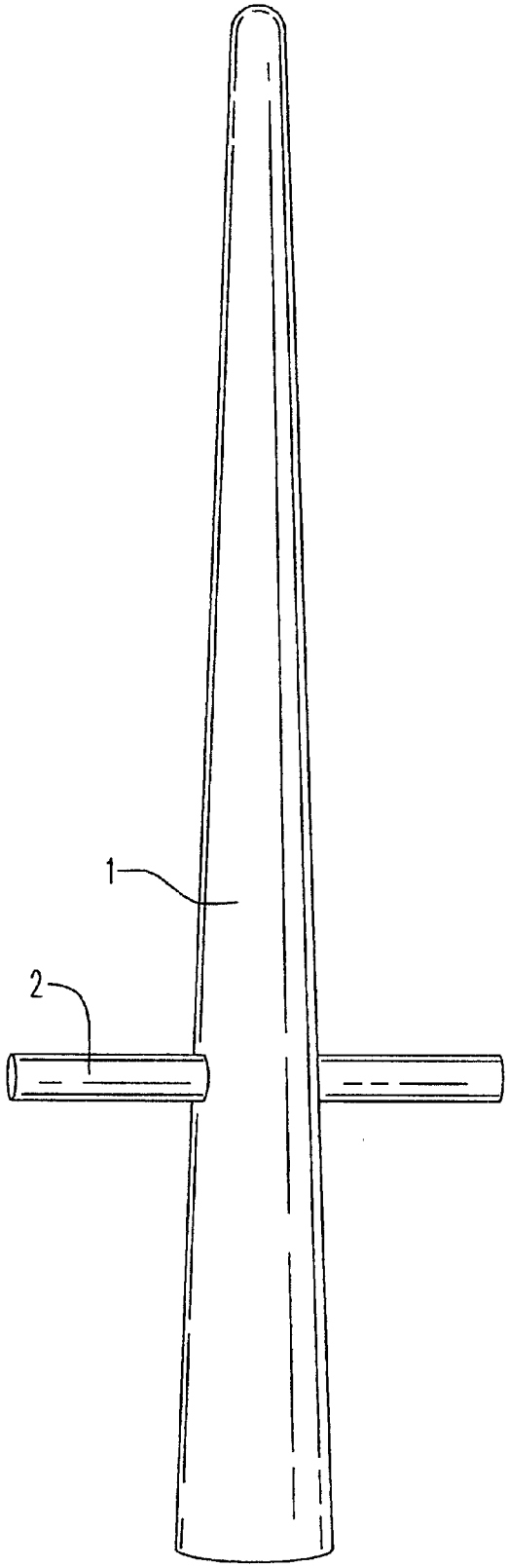
FIG. 2 is a perspective view of the toilet footrest with bar with a set of horizontal members and without a base.
Figure 5:
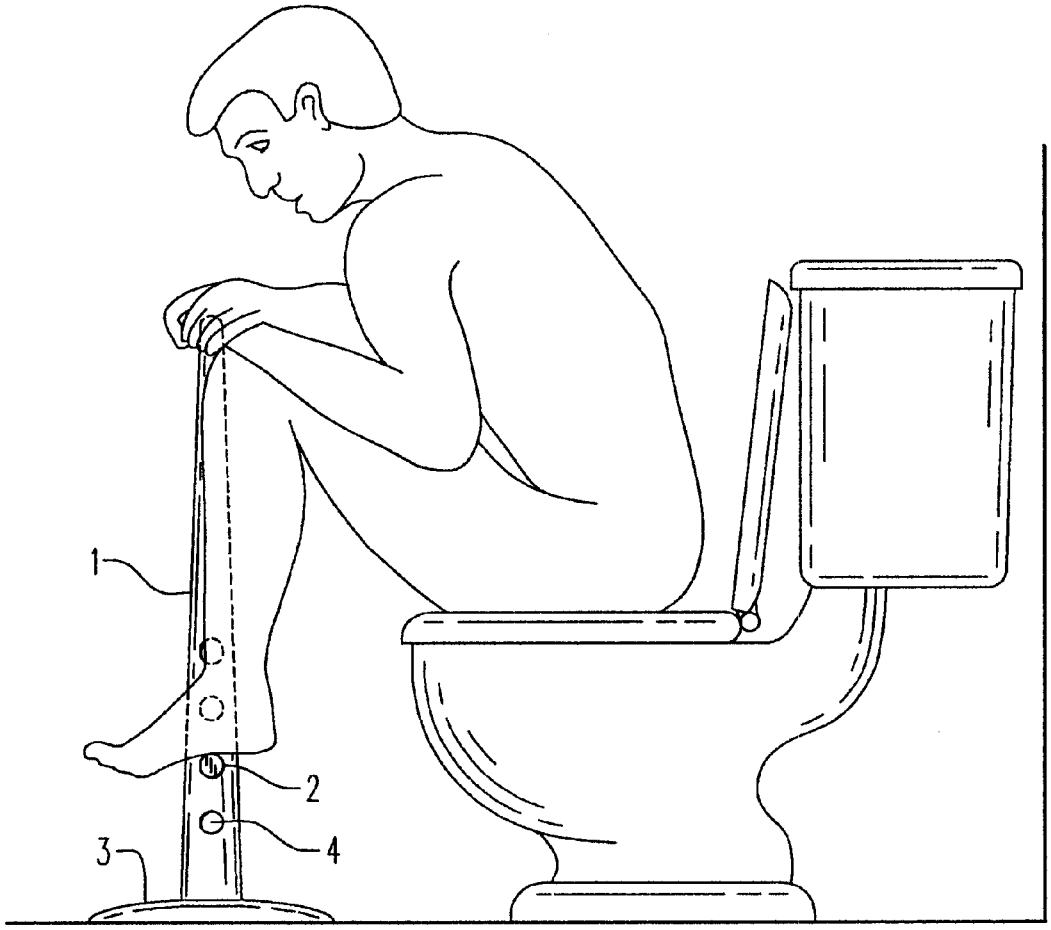
FIG. 5 is a side elevation view illustrating the manner in which the toilet footrest with bar is used.

Another embodiment of this invention incorporates a base 3 at one end of the vertical member 1 to facilitate the user of the device. This embodiment is illustrated by FIG. 2. The base 3 may be "U"-shaped to allow it to be stored at the base of the toilet more easily. The device in use is illustrated by FIG. 5.

Figure 3:
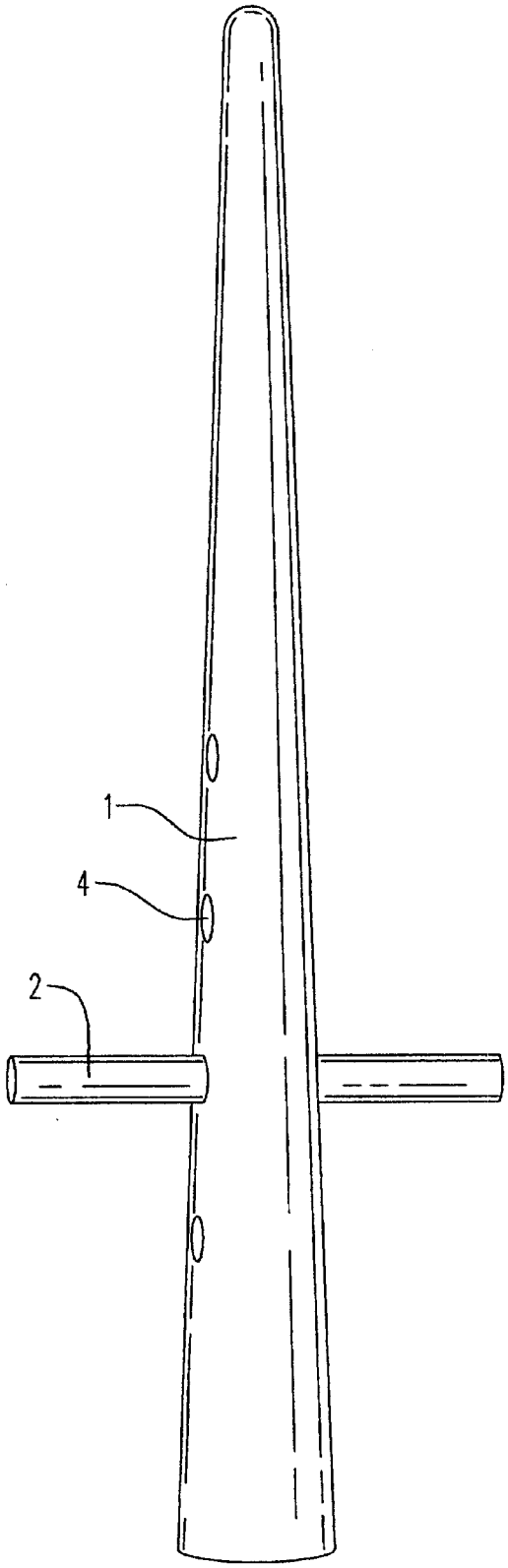
FIG. 3 is a perspective view of the toilet footrest with bar with holes for the horizontal members at horizontally opposed locations along the vertical member and with a base.
Figure 4:
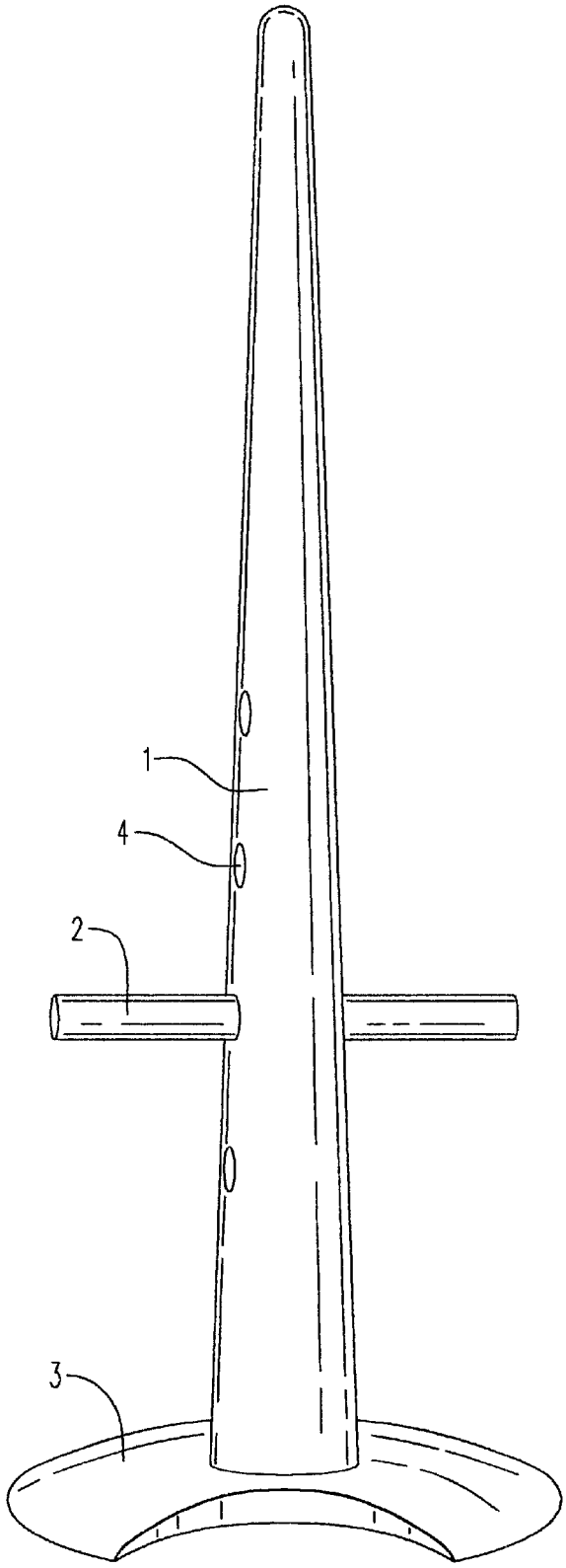
FIG. 4 is a perspective view of the toilet footrest with bar with holes for placement of the horizontal members at horizontally opposed locations along the vertical member with no base.

A third embodiment is shown in FIG. 3 wherein holes 4 having the same cross-sectional area and shape as the horizontal members 2 are placed at horizontally opposed locations along the vertical member 1. Using the holes 4, the user can place the horizontal members 2 at various elevations along the vertical member 1 to vary the amount of elevation of the feet of the user. FIG. 4 shows the vertical member 1 with holes 4 along its length at horizontally opposed locations and a base 3.

The toilet footrest with bar described herein and shown in the drawings represents only presently preferred embodiments of the invention. Various modifications and additions may be made to the above-described embodiments without departing from the spirit and scope of the invention. These and other modifications and additions may be obvious to those skilled in the art and may be implemented to adapt the present invention for use in a variety of different applications.

I claim:

1. A free standing footrest for use with a conventional toilet fixture to optimize the position of the user for easier defecation comprising a vertical member and at least one pair of horizontal members, each pair of horizontal members attached to the vertical member at horizontally opposed locations.

2. A free standing footrest for use with a conventional toilet fixture to optimize the position of the user for easier defecation comprising a vertical member, a base at one end of the vertical member, and at least one pair of horizontal members, each pair of horizontal members attached to the vertical member at horizontally opposed locations.

3. The free standing footrest for use with a conventional toilet fixture to optimize the position of the user for easier defecation according to claim 2 in which the base is "U"-shaped to fit around the base of the toilet.

4. A footrest for use with a conventional toilet fixture to optimize the position of the user for easier defecation comprising a vertical member having holes equally disposed at horizontally opposed locations at intervals along the length of the vertical member, and two horizontal members, each having the same cross sectional area and shape as the holes along the length of the vertical member, for insertion of one of the ends of each horizontal member into a set of horizontally opposed holes along the vertical member.

5. A footrest for use with a conventional toilet fixture to optimize the position of the user for easier defecation comprising a vertical member having holes equally disposed at horizontally opposed locations at intervals along the length of the vertical member, a base at one end of the vertical member, and two horizontal member, each having the same cross sectional area and shape as the holes along the length of the vertical member, for insertion of one of the ends of each horizontal member into a set of horizontally opposed holes along the vertical member.

6. The footrest for use with a conventional toilet fixture to optimize the position of the user for easier defecation according to claim 5 in which the base is "U"-shaped to fit around the base of the toilet.

* * * * *